US005390788A

United States Patent [19]

Schenkkan

[11] Patent Number: 5,390,788

[45] Date of Patent: Feb. 21, 1995

[54] GOLFBAG WITH INTEGRATED WISHBONE STAND

[76] Inventor: Robert H. Schenkkan, 3740 Blue Gum Dr., Yorba Linda, Calif. 92686

[21] Appl. No.: 16,728

[22] Filed: Feb. 11, 1993

[51] Int. Cl.[6] ..... A63B 55/00; A63B 55/06

[52] U.S. Cl. ..... 206/315.7; 206/315.3; 206/315.6; 248/96

[58] Field of Search ..... 206/315.3, 315.6, 315.7, 206/315.8; 248/96

[56] References Cited

U.S. PATENT DOCUMENTS

| | | | |
|---|---|---|---|
| 1,471,766 | 10/1923 | Wolfe | 206/315.7 X |
| 1,591,914 | 7/1926 | Farish | 206/315.7 X |
| 1,672,549 | 6/1928 | Thompson | 206/315.6 |
| 1,683,838 | 9/1928 | Mooney | 206/315.7 X |
| 1,970,849 | 8/1934 | Gunther | 248/96 |
| 2,186,491 | 1/1940 | Meyer | 206/315.7 |
| 2,282,842 | 5/1942 | Abell | 206/315.7 X |
| 2,283,412 | 5/1942 | Bright | 248/96 X |
| 2,571,088 | 10/1951 | Walton | 248/96 |
| 4,311,178 | 1/1982 | Kennedy | 206/315.6 |
| 4,506,854 | 3/1985 | Kim | 248/96 |
| 4,676,464 | 6/1987 | Reimers | 206/315.7 X |
| 4,778,136 | 10/1988 | Reimers | 206/315.7 |
| 4,834,235 | 5/1989 | Solheim et al. | 206/315.7 |
| 4,921,192 | 5/1990 | Jones | 248/96 |
| 4,949,844 | 8/1990 | Yang | 206/315.7 |
| 5,029,703 | 7/1991 | Dulyea, Sr. | 206/315.7 |
| 5,036,974 | 8/1991 | Ross, Jr. | 206/315.7 |
| 5,042,654 | 8/1991 | Jones | 206/315.7 X |
| 5,042,703 | 8/1991 | Izzo | 206/315.3 X |
| 5,042,704 | 8/1991 | Izzo | 206/315.3 |
| 5,154,377 | 10/1992 | Suk | 206/315.7 X |
| 5,221,030 | 6/1993 | Cretinon | 206/315.3 X |

FOREIGN PATENT DOCUMENTS

| | | | |
|---|---|---|---|
| 11777 | of 1896 | United Kingdom | 206/315.6 |
| 157632 | 1/1921 | United Kingdom | 206/315.6 |
| 180224 | 5/1922 | United Kingdom | 206/315.6 |

*Primary Examiner*—Sue A. Weaver
*Attorney, Agent, or Firm*—Charles H. Thomas

[57] ABSTRACT

A golf bag supported in a semi-upright position by a tripod stand that is automatically extended while the bag, is placed on the ground and tension is released from the shoulder strap or carry handle. When the bag is lifted by the shoulder strap or carry handle, the stand automatically retracts by means of a cord attached to the shoulder strap and carry handle. When the stand is in its fully extended position, it resembles the formation of a wishbone. The bag also provides inter-changeable pockets and diameter-compensating compartments for golf club organization and storage, and a strap and sliding buckle connected to the carry handle to permanently retract the stand during storage.

3 Claims, 5 Drawing Sheets

GOLFBAG WITH INTEGRATED WISHBONE STAND

BACKGROUND OF THE INVENTION

1. Field of the Invention

The present invention pertains generally to golf equipment and specifically to a golf carry bag with an automatic, integrated support stand, inter-changeable pockets, and diameter-compensating organizing compartments.

2. Description of the Prior Art

In the class of lightweight golf club carry bags, the prior art describes various types of integrated golf bag stand mechanisms including extensible stands, collapsible stands, and automatic stands. The prior art in U.S. Pat. No. 4,834,235 describes an extensible stand utilizing an elongated collapsible tubular body for support, and a toggle mechanism that moves the stand from a retracted to an extended position.

Prior art in U.S. Pat. No. 4,506,854 describes a collapsible bag and stand with removable support assembly, an upright tubular support, and spring-loaded mechanism to support the collapsible bag.

In other prior art describing automatic, integrated golf stands, U.S. Pat. No. 4,778,136 discloses a stand that is controlled by a series of three webbings in conjunction with the bag strap and elasticized shock cords. U.S. Pat. No. 5,036,974 further describes an automatic stand with legs that swing outwardly from adjustable, attached carrying plates.

While integrated stands in prior art address the need for lightweight, easy horizontal manipulation of the bag in addition to automatic extension and retraction of the stand, most prior art stands require the use of a shoulder strap to retract the legs. A shoulder strap provides an effective method of leg retraction during long sessions of walking, but repeated use of the strap when walking short distances becomes awkward and time-consuming.

The need for walking a short distance, resting the bag on the ground, and walking another short distance is a frequent occurrence during a round of golf. When traveling short distances, the golfer using prior art stands must either hoist the bag by its shoulder strap to retract the legs, or the golfer must lift the bag by its collar and negotiate around the extended legs which protrude approximately 19 inches from the bag.

When a bag is lifted by the carry handles in prior art described in U.S. Pat. No. 4,778,136, the legs are not retracted and the bag is caused to rotate forward due to weight of the golf clubs. This forward rotation of the bag, in addition to the stand extension, causes the extended stand to impede and obstruct the golfer's legs during short-distance travel.

The present invention includes both a shoulder strap retraction device and a carry handle retraction device in the form of a handgun to retract the legs, allowing the golfer to walk short distances and retract the legs with the carry handle, without the necessity of hoisting the bag to the shoulder. In the present invention, the shoulder strap is used to retract the legs while walking long distances and the carry handle is used to retract the legs while walking short distances.

In U.S. Pat. No. 4,912,192, there is described a golf carry bag with integrated stand that also allows a golfer to carry the bag in a retracted position with either the carry handle or shoulder strap. The present invention differs, however, because the leg stand in the prior art is extended by placing the bag on the ground, which releases a plunger-type device that otherwise holds the legs in place. This prior art does not address the problems encountered when playing golf on uneven terrain. When playing golf on a hillside or in a valley, which frequently occurs during a round of golf, the prior art bag and stand must be perfectly placed to ensure contact between the ground and the leg-stand plunger. If adequate contact between the ground and plunger device is not made, the leg-stand will not extend.

Unlike the prior art, the present invention's leg-stand automatically extends when tension is released from the carry handle or shoulder strap, allowing the golfer to easily place the bag at any position or angle created by the terrain of a golf course.

The present invention also provides greater leverage when retracting the legs by either the shoulder strap or carry handles. By utilizing a cord, the present invention allows a golfer to retract the legs with a 3-inch pull on the shoulder strap, while prior art mechanisms, with less leverage, require a 4–5 inch pull on the strap to retract the legs.

In addition to greater leverage provided when retracting the legstand, the present invention also eliminates the problem of legstand jamming. The problem of legstand jamming in the retracted position is one that frequently arises in prior art configurations. Jamming occurs when the webbings that connect and activate prior art mechanisms become obstructed. In the U.S. Pat. No. 4,778,136, an external pocket is sewn over areas through which the webbings must run to retract the leg stand. If an article of clothing is placed in the pocket, pressure exerted on the webbings frequently obstructs free movement of the webbings and prevents the legs from extending.

The present invention prevents this problem by retracting the legs by means of an internal cord housed in a protected channel. The channel is designed to provide an unobstructed pathway for the cord, virtually eliminating leg-jamming difficulties.

The present invention differs from all other prior art in that it utilizes a wishbone design that allows the retracted legs to be stored in a single, recessed housing. Prior art describes various housing mechanisms but none of the prior art features a singular, recessed housing mechanism for storing stand legs.

In U.S. Pat. No. 4,798,357, there is described a bag stand utilizing a sliding cam connected through linkage to two folding legs. In both the extended and retracted positions, the legs are separate. Prior art in U.S. Pat. Nos. 4,676,464, 4,778,136, 4,834,235, 4,949,844, and 5,036,974 also reflect separate storage for each of the legs. In the prior art of U.S. Pat. No. 5,042,654, there is described a singular storage position for both retracted legs, but the storage is external, as opposed to the recessed storage of the present art.

In addition to providing recessed storage for the legstand, the present invention also increases distance between the extended legs, which promotes greater tripod area and increased stability.

The present invention also addresses another problem encountered in bags designed according to the prior art. This problem occurs when golf club handles become lodged against each other at the base of the bag, preventing the golfer from easily pulling any club from the bag. The problem is compounded in narrower configurations of lightweight carry bags because the base of the bag is the same diameter as the collar of the bag, resulting in overcrowding and congestion of golf club handles. The present art mitigates this problem by providing a base that has a larger area than the collar, resulting in a slightly conical bag shape that provides more room at the base and also increases stability of the bag in an extended position. The present invention further reduces the club-congestion problem by segregating left-to-right, and front-to-back sections of the bag.

The present invention provides pockets on the golf bag that are inter-changeable, allowing the golfer to change the pockets to accommodate seasonal weather changes or to reduce weight and bulk of the bag.

Additionally, the present invention provides a dual-loop shoulder strap that differs from prior art of U.S. Pat. No. 5,042,704, by its attachment from the second to the first strap and then to the carry handle. In the prior art, both belts are attached to a single ring in the bag's midsection. The present art also differs from prior art in that the second strap in the present art is detachable. Both straps in the prior art are permanently affixed to the golf bag.

The present invention also provides a golf club organizer that differs from prior art disclosed in U.S. Pat. No. 5,029,703, because the present invention has six compartments for golf clubs instead of three compartments in the prior art. It also differs from prior art because the base of the bag has a larger diameter than the bag collar, which provides a larger area for golf-organizing compartments.

Another component of the present invention that is not addressed by prior art, is the aesthetic appearance of the golf bag in a retracted, carry position. The present invention provides a formed, recessed housing designed to accommodate the retracted stand mechanism and both legs in a single, nested shroud that is flush with the front body of the bag, and a permanent retraction mechanism to secure the stand when not in use.

The prior art provides no design for a recessed housing or permanent retraction mechanism in an automatic bag stand. This shortcoming, along with others described, indicate that the prior art falls short of addressing some of the problems of golfers who prefer to walk and carry a golf bag with an integrated stand.

Therefore, a need exists for a new and improved design of golf bag with integrated stand that will overcome the problems of short-distance walking, leg-jamming, club organization, instability, lack of personal customization, and cosmetic appearance. Any user of the prior art will greatly appreciate the simple yet effective solutions incorporated into the present invention.

SUMMARY OF THE INVENTION

In accordance with the present invention, a new and improved wishbone-designed integrated golf bag stand in combination with golf club organization, pocket customization, and cosmetic enhancement is disclosed.

The wishbone design of the integrated bag stand incorporates a bar that pivots outward from the front of the bag collar by means of a spring that is activated when a golfer sets down the bag and releases pressure on the carry handle or shoulder strap. As the bar pivots outward, a rod extending from a lower pivot point causes a slide to retract into the bar. As the slide retracts into the bar, it pulls two lever struts to a perpendicular orientation which causes the two legs to open to their full, extended position. In the extended, open position, the mechanism resembles an inverted wishbone.

The mechanism is linked together by a cord attached to and extending from a carry handle and shoulder strap. The cord runs from the carry handle on the back of the bag to the pivot bar on the front, and is housed in a channel located in the center of the bag. The stand is retracted in one movement by lifting the bag by either the carry handle or shoulder strap which is also attached to the carry handle.

When a golfer wishes to set down the bag of the present invention, the golfer simply places the bag on the ground and the subsequent release of pressure from the strap or handle activates the spring mechanism to cause the legs to automatically extend. To retract the legstand, the golfer lifts the bag by either the shoulder strap or carry handle. This feature allows the golfer to grasp the carry handle and retract the legstand while walking short distances. If the golfer wishes to carry the bag for longer distances, the golfer has the option of using the shoulder strap to retract the legstand.

One of the objects of the configuration of the legs in the present invention, is to create a larger tripod area, which increases bag stability in the upright position. An additional object is to extend the pivot region of the two legs to provide a more open area forward of the bag, which enables golfers to more easily walk with the stand extended if they elect to carry the bag by the collar instead of the carry handle or shoulder strap. A grip in the collar of the bag is provided to accommodate the golfer's option to carry the bag with the legstand extended.

The two shoulder straps in the present invention are designed to evenly distribute the weight of the bag when in the carry position. The second shoulder strap is easily detachable if the golfer elects to carry with only one strap.

The golf club organization portion of the bag provides left-to-right club separation as well as front-to-back separation by means of three horizontal compartments as viewed from the top of the bag. From this perspective the compartments which appear to be horizontally adjacent are bisected by a vertical divider, resulting in a total of six compartments. The base molding of the bag is 25% larger than the collar molding and is designed to eliminate club handles from becoming lodged in the based of the bag. The design of the present invention results in a slightly conical-shaped bag that allows more room for club organization, and increases stability in the upright position.

Another object of the new invention is to enhance the aesthetic appearance of the bag. The aesthetic enhancement of the bag is accomplished by providing a recessed housing for the legs and legstand to reside as a single, nested unit, flush with the front body of the carry bag. The sleek appearance of the legstand running the length of the bag as a single bar is a unique and welcome design.

These and other objects and advantages may become more fully understood from the following description when read in conjunction with the accompanying drawings.

DESCRIPTION OF THE PREFERRED EMBODIMENT

Figure 1:
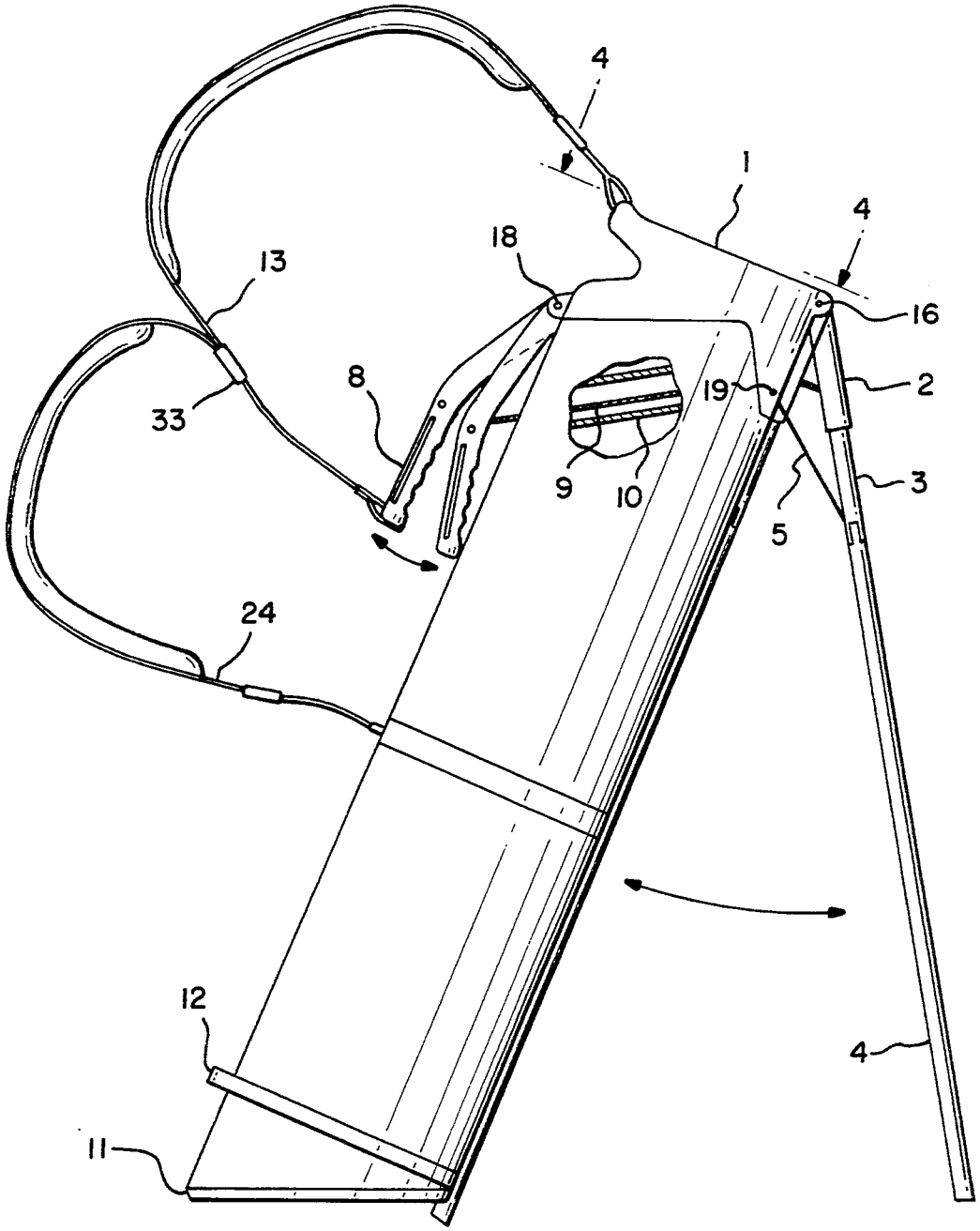
FIG. 1 is a general side view of the golf bag and stand combination of the present invention, with the legstand mechanism presented in both the retracted and extended position.
Figure 2:
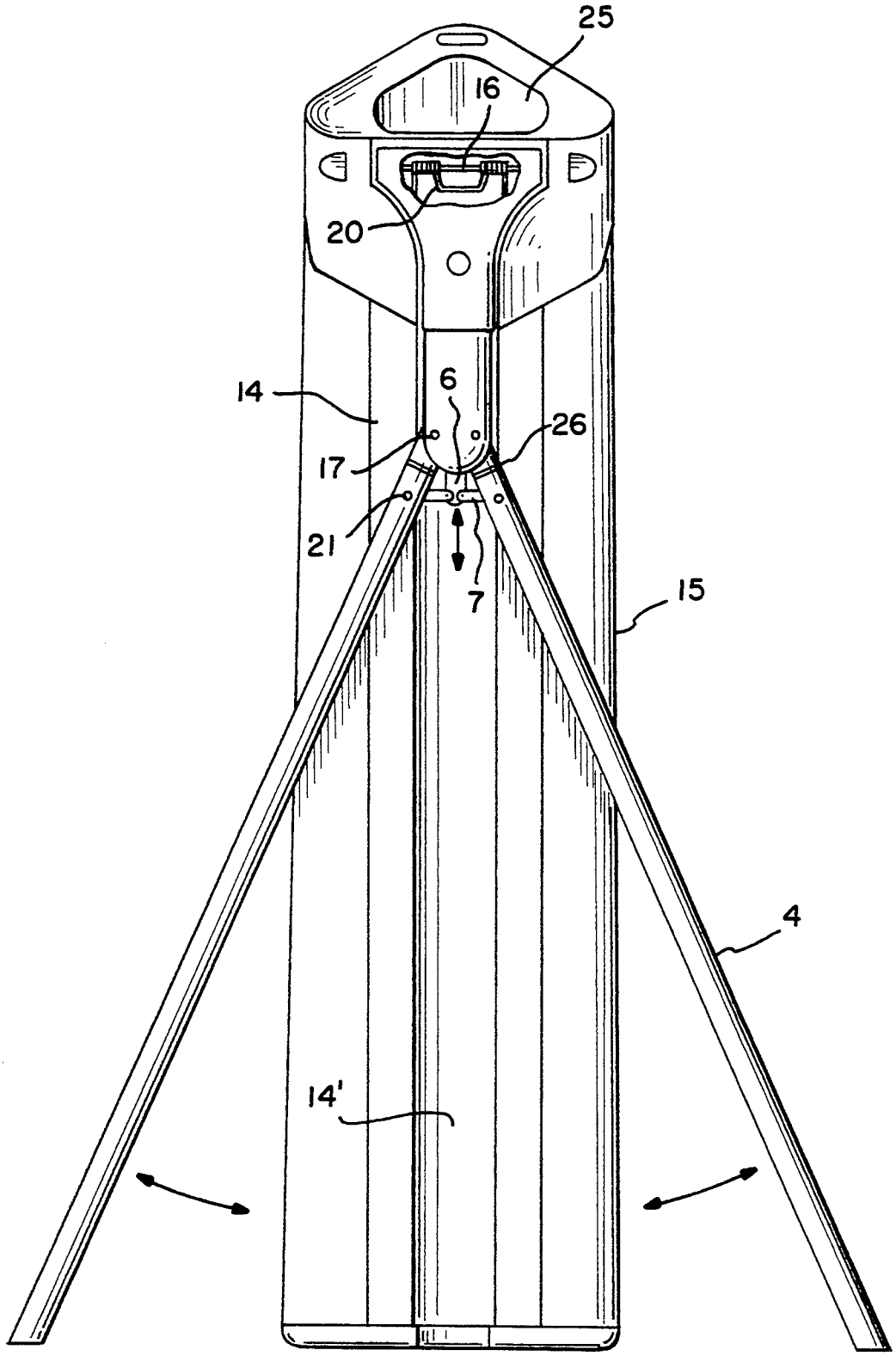
FIG. 2 is a general front view of the golf bag and stand combination, with a cut-out view of the spring.

Referring more particularly to the drawings, FIGS. 1 and 2 best show the golf bag and legstand combination of the present invention with the combination structure being generally indicated by the reference number 15. The golf bag 15 is basically describable as a fabric-covered cylinder which takes the form of the bag when secured to the base molding 11 at the bottom of the bag and the collar molding 1 at the top of the bag. A fabric strap 12 is attached to the bag 15 near the base molding 11 to provide a grip for lifting the bag 15 into the trunk of a vehicle. The collar molding 1 is basically the foundation structure for the entire mechanism. The collar 1 surrounds the opening 25 at the top of the bag 15. The base molding 11 has an area approximately 25% greater than the collar molding 1, to accommodate the greater area required for the aggregated diameters of golf club handles stored at the bottom of the bag.

Referring to FIG. 1, the preferred embodiment of the golf carry bag is shown in a side view in the position it would assume when the legstand is retracted, and the legstand is extended.

Referring to FIG. 1, the two legs 4 that assume a retracted or extended position are of a lightweight, metallic material extrusion, such as aluminum, with a special cross-section that enables the side-by-side cross-section of the two legs 4 to conform to the cross-sectional profile of the single pivot bar 3, resulting in a cosmetic appearance of a single, recessed bar while retracted. Seen in this figure is the pivot bar base molding 2, which connects the pivot bar 3 to the collar 1. A housing 14 is provided and extends between the collar 1 and the base 11 and provided a single longitudinal channel shaped recess 14' therein to receive both of the legs 4 therewithin.

Figure 3:
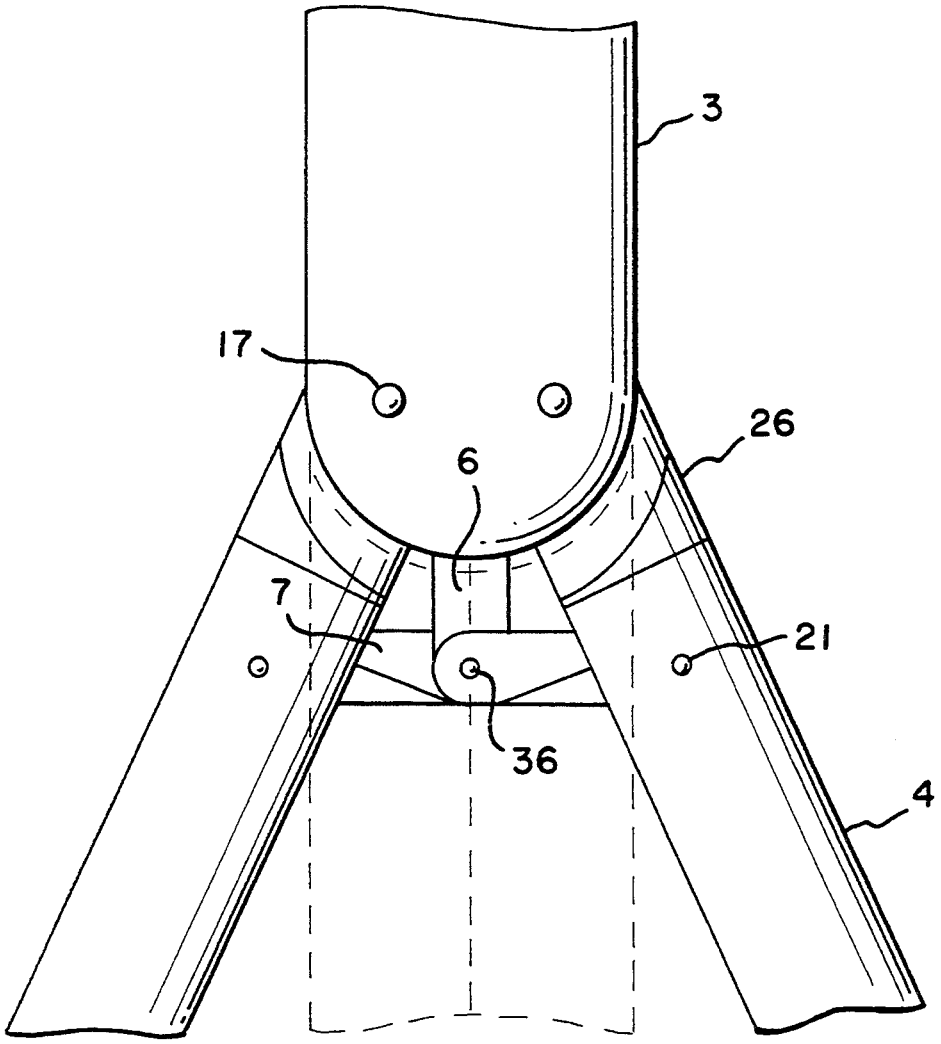
FIG. 3 is a sectional, diagrammatic view of the front of the legstand as seen from the front in the extended and retracted position.

Each leg 4 is attached to the pivot bar 3 by means of a separate leg pivot pin 17 which allows the legs 4 to pivot laterally from the pivot bar 3, and to open to their full, extended positions shown in FIGS. 2 and 3. Each leg 4 has a leg hinge insert 26 inserted into its top end. The leg pivot pins 17 are inserted through holes in the leg hinge inserts 26 and through holes in the walls of the pivot bar 3.

Referring to the more detailed view of FIG. 3, the relationship of the struts 7 with the legs 4 and slide 6 can be seen. The spring mechanism 20, shown in FIG. 2, provides the force necessary to rotate the pivot bar base molding 2 outwardly in rotation about the axis of the pivot shaft 16 relative to the collar molding 1 when the spring 20 is unrestrained by the cord 9. As the pivot bar base molding 2 is rotated on the pivot pin 16 outwardly away from the bag 15, it carries the pivot bar 3' with it. The spring 20 acts with sufficient force to also activate the slide 6, move the struts 7, and deploy the legs 4.

One of the major components of the bag 15 is the pivoting slide activating rod 5, which is attached at a first of its ends to the collar 1 by means of a pivot pin 19. When the spring 20 forces the pivot bar outwardly away from the bag 15, as indicated in FIG. 1, the second end of the slide activating rod 5 likewise pivots outwardly from the bag 15. The slide activating rod 5 retracts the slide 6 into the pivot bar 3. That is, the leg activation slide 6 is restrained or "held back" by the rod 5 as the pivot bar 3 pivots outward in response to the rotational movement of the pivot bar 3 under the control of the force of spring 20.

The "holding back" feature retracts the slide 6 from the position in which the legs 4 are nested within the elongated housing 14 into the position of FIG. 3. Since the pivot bar 3 moves relative to the slide 6, the pivot bar 3 forces the leg struts 7 to rotate outwardly about pin 36 into an orientation perpendicular to the length of the slide 6 as shown in FIG. 3. Each of the leg struts 7 is connected to a separate one of the legs 4. As the leg struts 7 are rotated apart from each other and into an orientation perpendicular to the slide 6, as shown in FIG. 3, the legs 4 are spread outwardly away from each other to their full extended positions shown in FIGS. 2 and 3.

As may be seen in FIG. 1, the leg-activation struts 7 are attached by means of a pivot pin 36 to the bottom of the slide 6 on one end by pivot pins 21, and to the legs 4 at the other end. In the retracted position, the pivot pin 36 that is attached to the slide 6 end of the strut 7 is positioned below the pivot pins 21 and attached to the leg 4 ends of the strut 7 as shown in FIG. 8. As the slide 6 is retracted into the pivot bar 3 as shown in FIG. 3, it pulls the struts 7 until the slide 6 and struts 7 form an inverted "T" such that the pins 21 are in a horizontal line perpendicular to the center line of the as shown in FIG. 3. As the leg assembly 4 is retracted, a wedge 39 on the slide 6 forces the legs 4 together.

Figure 5A:
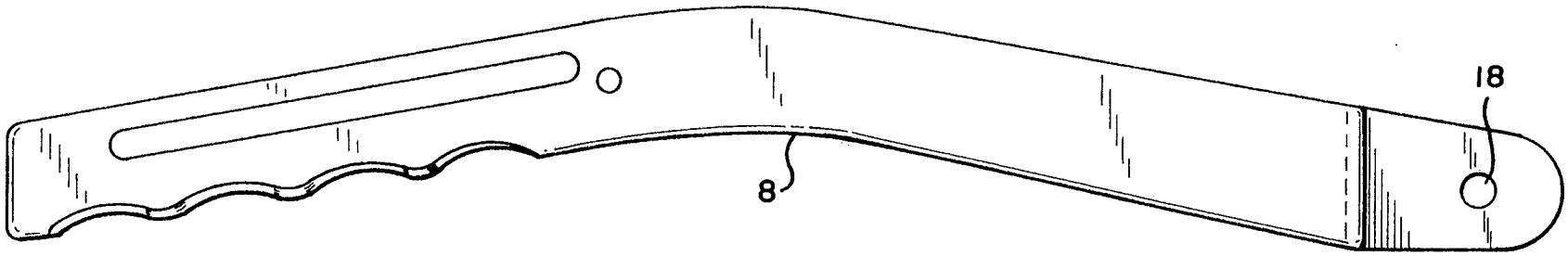
FIG. 5A is a side elevational view of FIG. 5.
Figure 5:
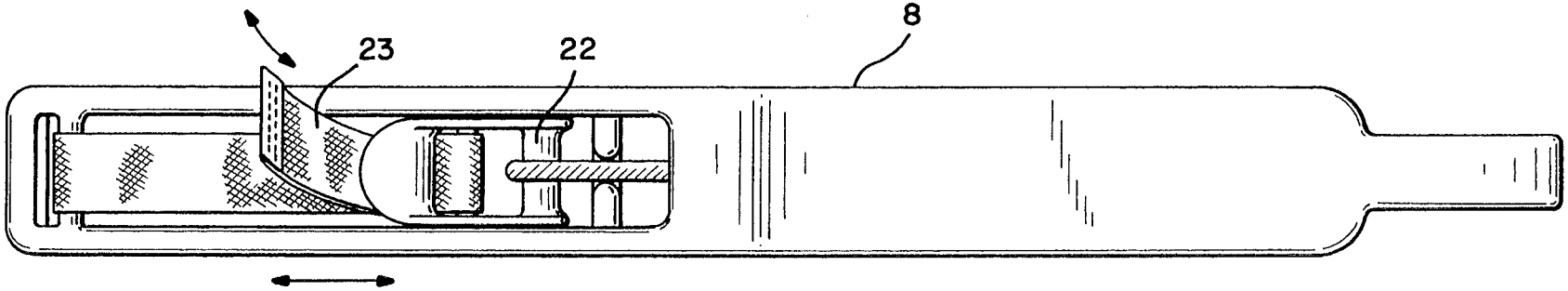
FIG. 5 is a detailed, diagrammatic view of the carry handle, buckle, and loop strap.

Referring to FIGS. 2 and 5, the activation handle 8 is a key component in the bag 15. The activation handle 8 provides the leverage required to pull the cord 9, which retracts the legstand. The activation handle 8 is attached to the collar 1 by means of a pivot pin 18. The cord 9, which is a strong, flexible, lightweight cord, is attached at one end to the handle 8 and on the other to the pivot bar 3. The cord 9 is threaded directly into a free and unobstructed channel 10 through which it slides as the legstand is retracted and extended. The channel 10 runs directly through the center of the bag 15 from the front of the bag to the back. Attached to the activation cord 9 is the sliding buckle 22. The buckle 22 slides along the length of the hand portion of the activation handle 8. The position of the sliding buckle 22 can be adjusted by retracting or releasing the protruding end of the loop strap 23. When completely retracted, the loop 23 is a its smallest diameter rendering the stand completely retracted.

Referring now to FIG. 5, the loop strap 23 is approximately $\frac{3}{4}$ in. wide and is secured at the bottom of the activation handle 8 and the sliding buckle 22. The circumference of the loop strap 23 is reduced, drawing the sliding buckle 22 toward the bottom of the handle 8.

This in turn draws the cord 9 to permanently retract the pivot bar 3 and legs 4 for storage. When preparing for use, the sliding buckle 22 is lifted by releasing the loop strap 23, allowing the spring mechanism 20 to force the legstand to its full, extended position. The cord 9 is attached to the sliding buckle 22 which slides up and down in the handle 8. The buckle 22 can be permanently retracted when the loop strap 23 is pulled closed, thereby permanently retracting the legstand mechanism for storage when the bag 15 is not in use.

Referring to FIG. 1, there is a view of attachment location of the double shoulder strap 24, which attaches to the bag 15 and to the shoulder belt 13 with a snap connector 33 and is easily detachable from the bag 15. The shoulder strap 13 is attached through the bottom end of the activation handle 8 and attaches the collar 1 and the activation handle 8. When utilized, the shoulder strap 13 retracts the carry handle and subsequently the legs 4.

Referring now to FIG. 1, there is a detailed segmental view of the cord 9 and the channel 10 through which the cord slides. The channel 10 is a rigid structure with approximately $\frac{1}{4}$ in. width, and approximately 2 in. in height. The length is sufficient to connect the channel 10 from the front of the bag 15 to the back of the bag 15, and to allow the cord 9 to easily slide through the channel 10, allowing free extension and retraction of the legstand 4.

Figure 4:
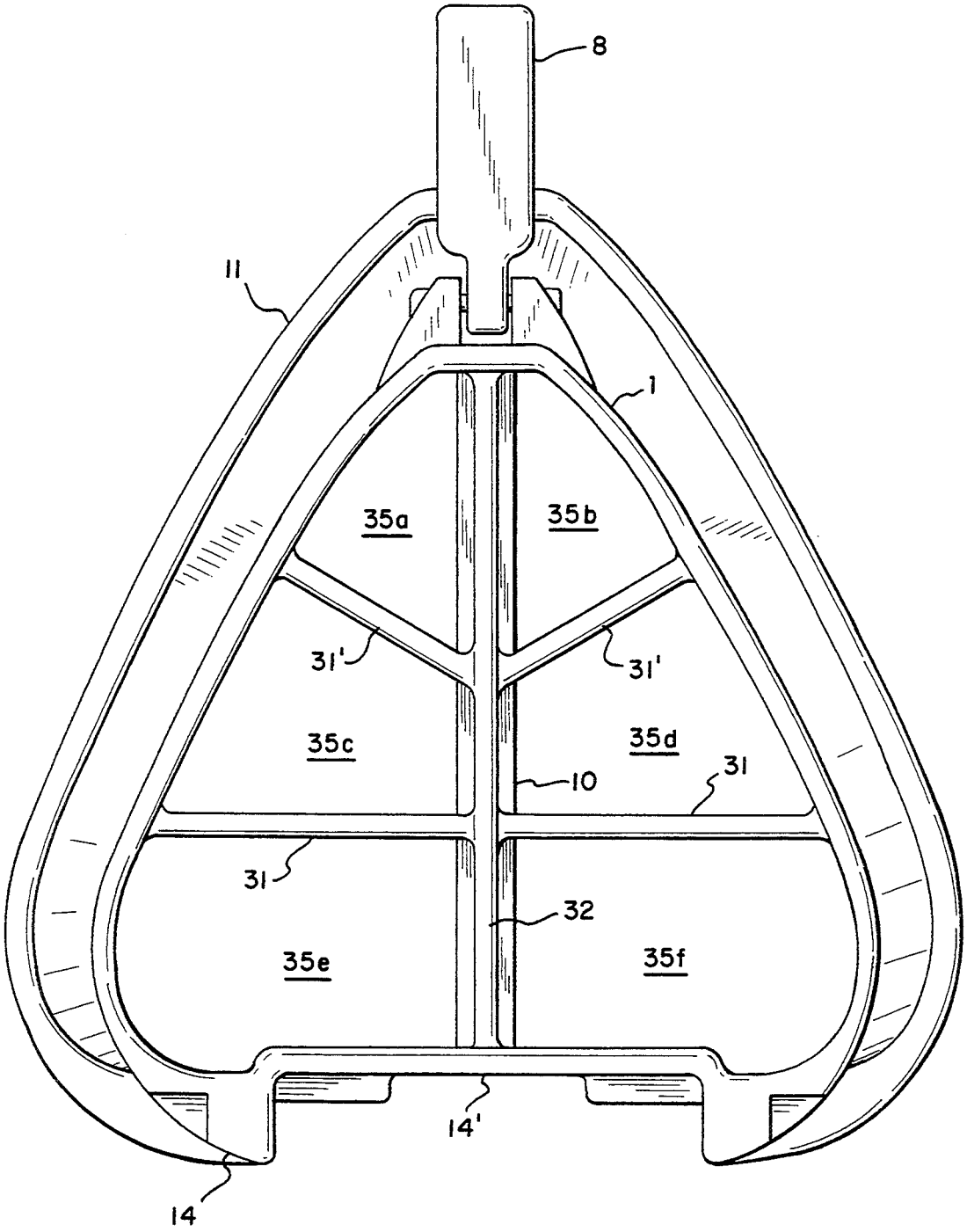
FIG. 4 is a top view of the golf bag showing the configuration of the organizing compartments taken along the lines 4—4 of FIG. 1.

Referring now to FIG. 4, the top collar 1 view of the invention, there is diagrammed that portion of the golf carry bag 15 that pertains to golf club organization and storage. In FIG. 4, the collar 1 view of the bag 15 describes three compartments segmented by dividers 31 that appear horizontal and dividers 31' that extend laterally in the plane of FIG. 4. The compartments are bisected by one divider 32 that appears vertical in the plane of FIG. 4, resulting in a total of six separate compartments 35*a*, 35*b*, 35*c*, 35*d*, 35*e* and 35*f*. The six compartments 35*a*–35*f* assist the golfer to facilitate golf club storage and retrieval. As is evident in FIG. 4 the base molding 11 has an area approximately twenty five percent greater than the collar molding 1 to accommodate the greater area required for the aggregated diameters of golf club handles stored at the bottom of the bag.

What is claimed is:

1. A golf bag and automatic stand for supporting said bag in an upright position comprising in combination:

(a) a golf bag having a front and a back and suited for holding and organizing golf clubs therein and having upper and lower extremities, a collar on said upper extremity of said bag, a base on said lower extremity of said bag, and a housing extending between said collar and said base at said front of said bag and defining therein a single concave elongated recess extending longitudinally along said front of said bag, (b) an automatic bag stand including a bar having a first end rotatably attached to said collar at said front of said bag and an opposite second end having a lower extremity a spring urging said bar to rotate said second end of said bar outward away from said bag, a pair of legs having lower and upper extremities and extending longitudinally therefrom, means pivotally coupling said upper extremities of said legs to said lower extremity of said bar, a leg extension and retraction mechanism that forces said lower extremities of said legs apart from each other when said second end of said bar is rotated outward away from said bag and that collapses said lower extremities of said legs together when said bias of said spring is overcome, a cord passing through said bag from back to front and coupled to said bar, and an activation handgrip having an upper extremity pivotally connected to said collar and having a lower end connected to said cord, whereby when said lower end of said handgrip is pulled outwardly away from said bag, said legs are collapsed together and pulled into said single longitudinal recess and when said handgrip is released said spring pushes said bar outward from said bag and said lower extremities of said legs are forced apart.

2. A golf bag and automatic stand according to claim 1 wherein said collar and said base are molded structures and said handgrip is mounted on said collar, and wherein said base is larger is area than said collar.

3. A golf bag and automatic stand according to claim 1 further comprising a strap retraction mechanism coupled to said bag and to said handgrip, and said strap retraction mechanism is adjustable in length to thereby secure said leg stand in a retracted position when not in use.

* * * * *